US006815616B1

(12) United States Patent
King, Jr. et al.

(10) Patent No.: US 6,815,616 B1
(45) Date of Patent: Nov. 9, 2004

(54) STRAIN RELIEVED WIRE CONNECTOR

(75) Inventors: Lloyd Herbert King, Jr., Chesterfield, MO (US); Michael Belgeri, Ellisville, MO (US); James Keeven, O'Fallon, MO (US)

(73) Assignee: King Technology of Missouri, Inc., St. Charles, MO (US)

( * ) Notice: Subject to any disclaimer, the term of this patent is extended or adjusted under 35 U.S.C. 154(b) by 0 days.

(21) Appl. No.: 10/654,076

(22) Filed: Sep. 3, 2003

(51) Int. Cl.[7] ..... H01R 4/22
(52) U.S. Cl. ..... 174/87
(58) Field of Search ..... 174/74 R, 84 R, 174/86, 87, 138 F; 403/214, 265; 264/272.11, 274, 295, 296, 297.2; 439/449

(56) References Cited

U.S. PATENT DOCUMENTS

| | | | | | |
|---|---|---|---|---|---|
| 3,109,051 | A | | 10/1963 | Vogel | 174/87 |
| 3,558,800 | A | | 1/1971 | Wallis | 174/87 |
| 4,053,704 | A | | 10/1977 | Smith | 174/87 |
| 4,438,995 | A | * | 3/1984 | Fisher et al. | 174/87 |
| 4,721,832 | A | * | 1/1988 | Toy | 174/87 |
| 4,740,656 | A | * | 4/1988 | Rich | 174/87 |
| 4,751,350 | A | * | 6/1988 | Eaton | 174/87 |
| 4,839,473 | A | | 6/1989 | Fox | 174/138 F |
| 5,023,402 | A | | 6/1991 | King, Jr. et al. | 174/87 |
| 5,038,003 | A | | 8/1991 | Allec et al. | 174/138 F |
| 5,113,037 | A | | 5/1992 | King, Jr. et al. | 174/87 |
| 5,132,494 | A | * | 7/1992 | Burton et al. | 174/87 |
| 5,151,239 | A | | 9/1992 | King, Jr. | 264/272.11 |
| 5,252,779 | A | * | 10/1993 | DiRienzo | 174/87 |
| 5,315,066 | A | | 5/1994 | Spiteri | 174/87 |
| 5,357,057 | A | * | 10/1994 | Debbaut | 174/84 R |
| 5,431,758 | A | * | 7/1995 | Delalle | 174/84 R |
| 5,559,307 | A | * | 9/1996 | Whitehead et al. | 174/87 |
| 5,567,916 | A | * | 10/1996 | Napiorkowski et al. | 174/153 G |
| 5,894,110 | A | * | 4/1999 | Simmons et al. | 174/87 |
| 6,025,559 | A | | 2/2000 | Simmons | 174/87 |
| 6,051,791 | A | | 4/2000 | King | 174/87 |
| RE37,340 | E | | 8/2001 | King | 174/87 |
| 6,478,606 | B1 | * | 11/2002 | McNerney et al. | 174/87 |
| 6,570,094 | B2 | * | 5/2003 | King, Jr. | 174/87 |

* cited by examiner

*Primary Examiner*—Chau N. Nguyen
*Assistant Examiner*—Adolfo Nino
(74) *Attorney, Agent, or Firm*—Jacobson & Johnson

(57) ABSTRACT

A twist-on wire connector having a housing with a spiral tread for engaging and holding electrical wires in an electrical connection and a chamber for carrying a member having a wire passageway so that the electrical wires can be retained within the connector by conforming the member about the wires to inhibit strain therein and a method of making an electrical connection that inhibits strain of the wire by inserting a plurality of wires into a spiral thread of a twist-on wire connector, rotating the plurality of wires to bring the electrical wires into electrical connection with each other and squeezing a member around the plurality of wires to bring the member into pressure contact along a portion of the plurality of wires to thereby inhibit strain on the plurality of wires held in the electrical connector.

28 Claims, 3 Drawing Sheets

STRAIN RELIEVED WIRE CONNECTOR

FIELD OF THE INVENTION

This invention relates generally to a strain relieved wire connector and more specifically to strain relieved twist-on wire connectors that lessen the likelihood that the frictionally joined wires held therein will be dislodged or loosened due to external forces and to a method of making an electrical connection that inhibits or reduces strain on the electrical wires located in the connector.

CROSS REFERENCE TO RELATED APPLICATIONS

None.

STATEMENT REGARDING FEDERALLY SPONSORED RESEARCH OR DEVELOPMENT

None.

REFERENCE TO A MICROFICHE APPENDIX

None.

BACKGROUND OF THE INVENTION

A number of connectors are known in the art for holding wires in electrical connectors. A number of different embodiments are known for use in relation twist-on wire connectors or related connectors. The following are examples of various connectors that include some type of assistance for holding the wires within the connector.

U.S. Pat. Nos. 5,151,239; 5,113,037; 5,023,402 and Re 37,340 show a twist on wire connector with external clips that the wire is looped around to hold the wire in the connector.

U.S. Pat. No. 6,025,559 discloses a twist-on wire connector where the wires are joined in a bundle and inserted into the twist-on wire connector.

U.S. Pat. No. 6,051,791 shows a connector wherein wires are twisted and wrapped around a v-shaped slot in a shell to hold the wires in position as the wires are inserted into a sealant.

U.S. Pat. No. 5,315,066 shows a twist-on wire connector wherein a barrier layer is hardened around the wires in a twist-on wire connector to hold the wires in the wire connector.

U.S. Pat. No. 5,083,003 shows a n enclosure to prevent the wires from being removed from the housing.

U.S. Pat. No. 4,839,473 discloses a splice enclosure where a twist-on wire connector is held with in a housing with the entire twist non wire connector is inserted in the housing and the wires are inserted into channels in order to strain relive the connection.

U.S. Pat. No. 4,053,704 discloses a wire connector having the a plug with arms on a plug to restrain the wires in the connector.

U.S. Pat. No. 3,109,051 shows an electrical connector with a locking element having openings therein for inserting wires to hold the wires in the connector. Although the art is replete with various members to hold the electrical wires in the electrical connector through hooking or looping the wire around a member there is need for a connector that minimizes or reduces the strain on a plurality of wires that are secured in a twist-on wire connectors. In addition, there is a need for a simple easy to use twist-on wire connector that can secure the wires into an electrical connection as well as secure the wires in a strain free condition in the wire connector either during the insertion of the wires into the connector or after the wires have been inserted into the electrical connector. The present invention provides for on-the-go formation of an electrical connection that inhibits strain on the electrical connections and permits a user to reuse or readjust the wires in the electrical connector.

SUMMARY OF THE INVENTION

A twist-on wire connector having a housing with a spiral thread for engaging and holding electrical wires in an electrical connection and a chamber for carrying a member having a wire passageway so that the wires can be retained within the connector by conforming the member about the wires to thereby inhibit strain on the wires and a method of making an electrical connection that inhibits strain of the wire by inserting a plurality of wires into a spiral thread of a twist-on wire connector, rotating the plurality of wires with respect to the connector to bring the electrical wires into electrical connection with each other and forcing the member around the plurality of wires to bring the member into pressure contact with the plurality of wires over an extended region to thereby inhibit strain on the plurality of wires held in the electrical connector.

DESCRIPTION OF THE PREFERRED EMBODIMENT

Figure 1:
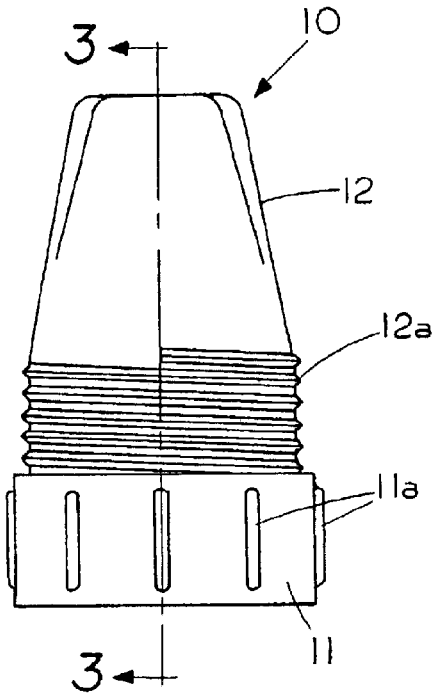
FIG. 1 is a front elevation view of the strain inhibiting twist-on wire connector.

FIG. 1 is a front elevation view of strain inhibiting twist-on wire connector 10 having an electrically insulating housing or shell 12 having a closed end and an open end with a set of external male threads 12*a* extending around the peripheral region proximate the open end of the housing 12. Located on the open end of housing 12 is an open ended, flanged cap 11 with an internal threaded sidewall for engaging the threads 12*a* on housing 12. A set of elongated finger grips 11*a* extend transversely thereon to enable one to grasp and rotate end cap about housing 12.

Figure 2:
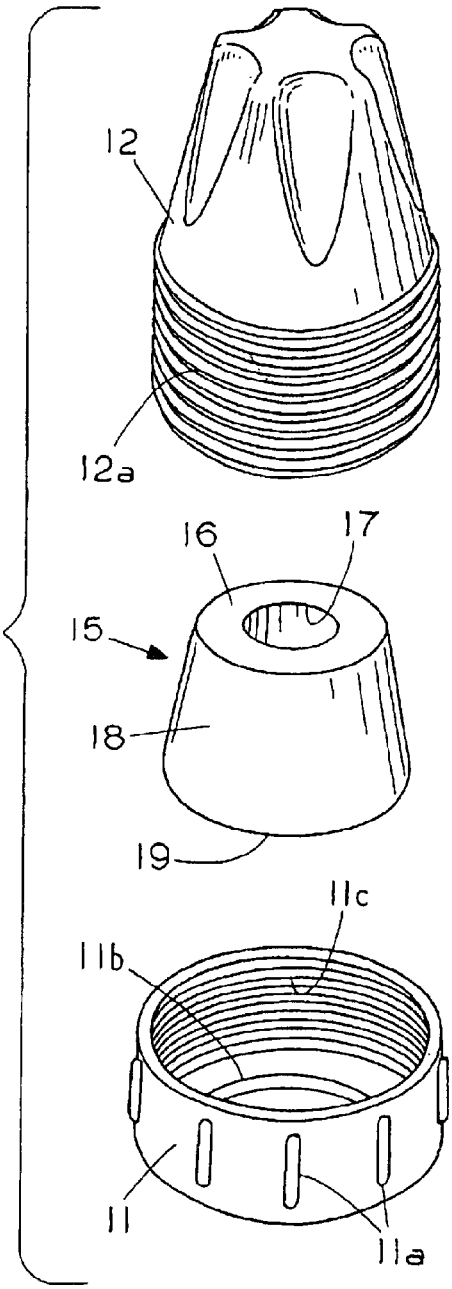
FIG. 2 is an exploded view of the strain inhibit twist-on wire connector of FIG. 1.

FIG. 2 is an exploded view of the strain inhibiting twist-on wire connector 10 showing the housing 12 with the external threads 12*a* thereon. Located below housing 12 is a wire-engaging member comprising a deformable insert 15 having a top annular surface 16, a bottom annular surface 19 a conical taper sidewall 18 and a central wire passageway 17 extending axially through the deformable insert 15. Located below the deformable insert 15 is the open ended cap 11 having a flange 11*b* for engaging a portion of deformable insert 15 end surface 19 and a set of internal threads 11*c* for rotatingly engaging the thread 12*a* on exterior of housing 12 to enable one to simultaneously squeeze the deformable insert into a chamber in the housing 12 and about a wire or wires extending therethrough as well as against an interior side wall of housing 12.

Figure 3:
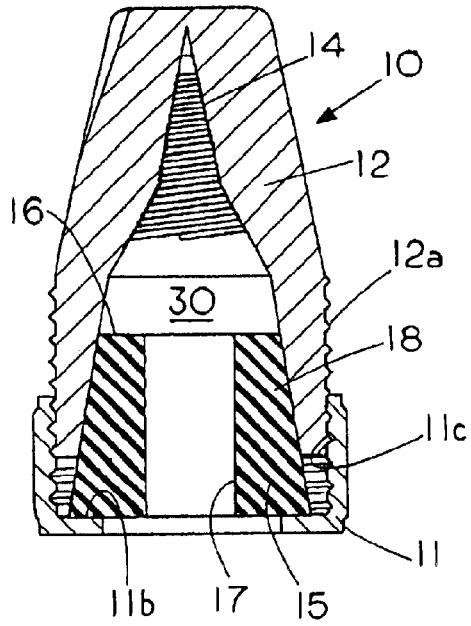
FIG. 3 is a sectional view taken along lines 3—3 of FIG. 1.

FIG. 3 is a sectional view taken along lines 3—3 of FIG. 1 showing twist on wire connector 10 in cross section but without any wires therein in order to reveal a wire coil 14 located at the closed end with the wire coil having a spiral thread therein for engaging and holding the ends of twisted wire leads therein. In the embodiment shown the spiral thread is formed in a wire coil 14 and the wire coil 14 is then inserted in the housing 12. In an alternate embodiment the spiral thread can be formed directly into the internal surface or side wall of the housing thereby eliminating the need for a separate wire coil for engaging the wires therein.

Deformable member 15 comprises a collar having a frusto conical shape and is shown with an external tapered surface 18 in contact engagement with an internal tapered surface 12*c* located on the interior of housing 12. Located in the open end of housing 12 is a chamber 30 with deformable member 15 located partially in chamber 30. In the embodiment shown cap 11 is in partial engagement with threads 12*a* and the wire passageway 17 is in a open or unengaged condition for insertion of electrical wires therethrough. Deformable member 15 is positioned so that axial insertion of deformable member toward the closed end of housing 12, i.e. by rotation of cap 11, causes the rigid side walls 12*c* to compress the deformable member 15 through radial pressure on deformable member 15 side wall 18 which in turn causes the deformable member to contract the diameter of the passageway 17 and bring the deformable member into engagement with any wires therein.

In the preferred embodiment the deformable member 15 comprises a material such as an electrical insulating elastomer or the like that can be squeezed to conform to the external surfaces of wires extending therethrough. The advantage of an elastomer, which is made from a resilient material, is that one can release the grip on the wires by reducing the compressive pressures on the wire connector. Thus the connector becomes reusable as well as suitable for adding wires to the connector.

In order to obtain strain relieving engagement between the member 15 and the wires the relationship of the size or cross sectional area of the wire passageway therein to the external dimensions or cross sectional area of a wire extended therethrough is such that when the cap 11 is brought into engagement the deformable member deforms about an exterior surface of the wire to cushioningly engage and support at least a portion of wire therein. By using an elastomer material that is sufficiently soft to yield as an external bending or pulling force is placed on the wire it distributes any force on the wire over a wide area and avoids any sharp bends or kinks in the wire. That is, the elastomer material allows the wires to form a gradual curve if a force is applied to the wire as opposed to an abrupt angle, such as when the wire is held in a clamp. Thus it can be appreciated that the wires are resiliently or yieldable held in the end of the wire connector so that a limited amount of flexing and bending of the wires can occur over an extended region of the wires thus minimizing strain on the wires as well as strain on the ends of the wire that are in electrical contact in the wire connector.

If one wants to prevent moisture from entering therepast the deformable member is compressed or deformed until the deformable member 15 deforms or flows completely around the wires 28 and 29 to fill any gaps between the wires and the sidewall passageway 17 to thereby prevent moisture from entering into the wire connecting chamber in the wire connectors.

In the unengaged condition or ready to use condition, which is illustrated in FIG. 3, the end cap 11 is in engagement with housing 12 but the end cap 11 has not been brought into full engagement with housing 12. In this condition the deformable member 15 is in a relaxed condition ready to be compressed and squeezed.

Figure 4:
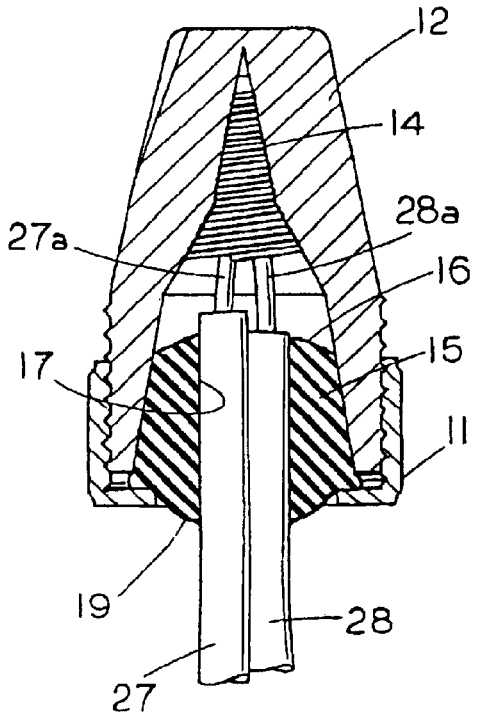
FIG. 4 is a cross sectional showing a plurality of wires in a wire restraining condition in the strain inhibit twist-on wire connector of FIG. 1.

FIG. 4 shows the twist-on wire connector in the strain inhibiting mode with an electrical wire 27*a* and an electrical wire 28*a* in electrical engagement with each other in the spiral coil 14. The electrical wire insulation cover 27 of electrical wire 27*a* and the electrical wire insulation cover 28 of wire 28*a* extend through the passageway 17. FIG. 4 shows the end cap 11 has been partially rotated to squeeze and compress member 15 about the electrical wire covers 27 and 28. As can be seen in FIG. 4, the deformable material has been forced to flow around the wire covers 27 and 28 to thereby engage the wire covering to frictionally grip and assist in retaining the wire covers 27 and 28 in relation to the deformable member 15. As the deformable member 15 is held in position in housing 12 by the flanged end cap 11 the wires are restrained from axial movement in connector 12 and since the deformable member extends over a substantial length of the wires the wires are held in strain inhibiting condition in wire connector housing 12.

Figure 5:
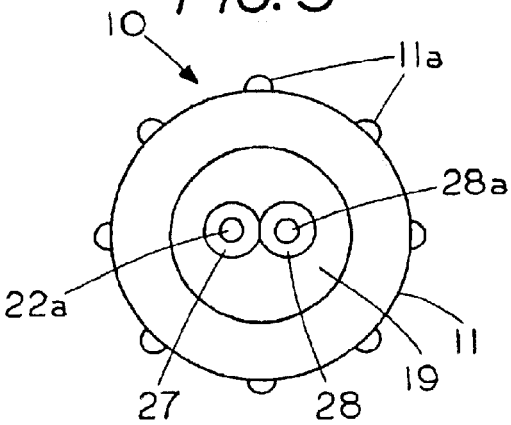
FIG. 5 is an end view of the strain inhibit twist-on wire connector of FIG. 4.

FIG. 5 shows an end view of the connector 10 showing how the deformable member 19 has been deformed about the exterior wire covers 28 and 29 with the wires extending through the central opening in the flanged end cap 11. In the embodiment shown the deformable member 15 has been compressed radially inward to form an enclosure or moisture sealing engagement around wire covers 27 and 28. Thus, through a rotation of end cap 11 one can squeeze deformable member 15 about the electrical leads to bring the electrical leads into tight engagement with the deformable member to not only anchor the electrical leads but to provide a strain inhibiting electrical connection since any lateral strain on the wires is absorbed over an extended area by the yieldable member 15 which extends into the housing 12.

Figure 6:
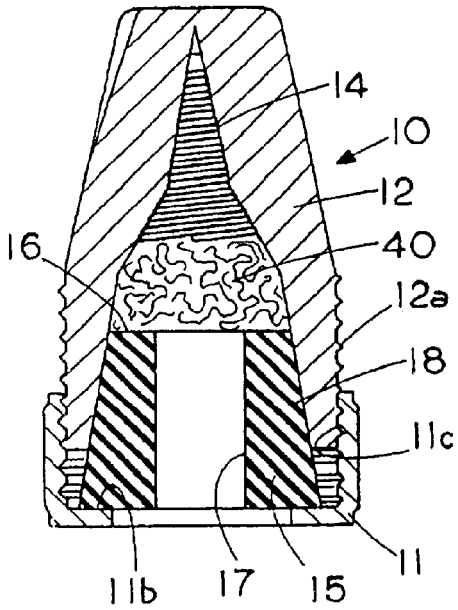
FIG. 6 is a cross sectional view of strain inhibit twist-on wire connector with a viscous sealant located therein.

FIG. 6 shows an alternate embodiment of the twist-on wire connector 10 wherein a viscous sealant 40 is located in the chamber in the housing of connector 10. This embodiment is suitable for those conditions where the deformable member 15 may not be sufficiently radially compressible to form a leakproof seal along the length of the wire in the deformable member 15.

The present invention thus comprises a method of inhibiting strain in a set of wires joined in a twist-on wire connector by inserting a plurality of wires through a deformable member and into a spiral thread of a twist-on wire connector, rotating the plurality of wires to bring the electrical wires into an electrical connection with each other and squeezing the deformable members around the plurality of wires to bring the deformable member into extended area pressure contact with the plurality of wires to thereby inhibit strain on the plurality of wires held in the electrical connection.

While the yieldable member 15 is shown as a one-piece collar with a cylindrical opening it is envisioned that two or more members could be used for grasping and holding the electrical wires.

Figure 7:
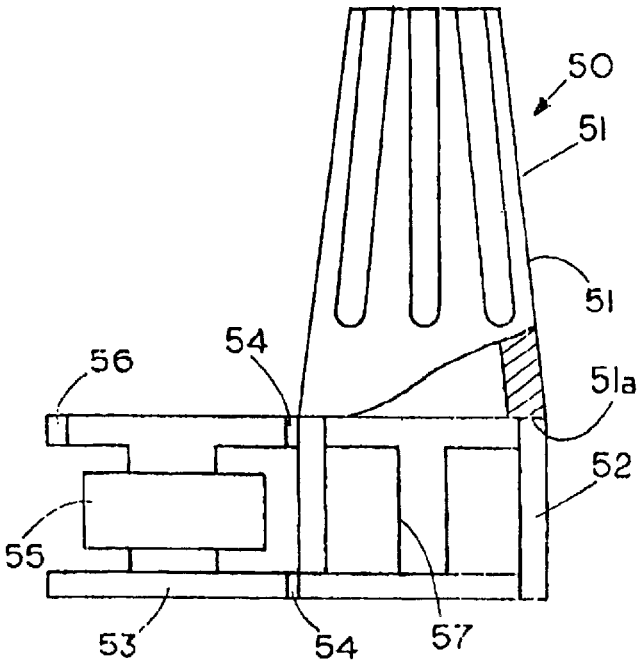
FIG. 7 is a side view of an alternate embodiment of a strain inhibiting twist-on wire connector an open face condition.

FIG. 7 is a side view of an alternate embodiment of a strain inhibiting twist-on wire connector 50 an open face condition comprising a twist-on wire connector 51 having a wire engaging member 52 secured to an end face 51*a* of wire connector 51. Wire engaging member includes a first pad 57 and a second pad 55 which can be brought into a face to face position by pivoting a clamp member 53 about a living hinge 54. A latch 56 is located at the end of member 53 for engaging with member 52 to hold the wire engaging member 52 in a closed condition about a wire or wires located in the twist-on wire connector.

Figure 8:
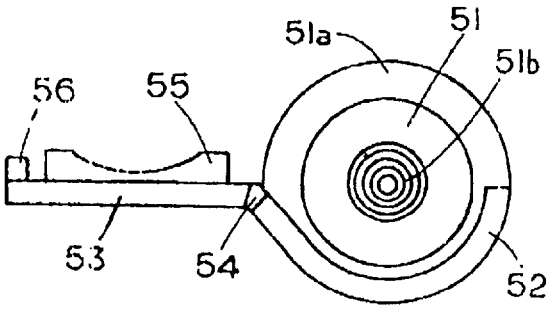
FIG. 8 is an end view of the strain inhibiting twist-on wire connector of FIG. 7.

FIG. 8 is an end view of the strain inhibiting twist-on wire connector 50 in the open condition showing the wire engaging member 52 has a curved portion that is secured to end face 51*a* of wire connector 51. Wire engaging member 52 can be secured in any of a number of ways including adhesively securing as well as being integrally molded with the shell of the twist-on wire connector. Although member 52 is secured to end face 51*a* it is understood that member 52 can be secured to other portions of the twist-on wire connector including the interior of the twist-on wire connector. As can be seen in FIG. 8 one can engage wires in the twist on wire connector coil 51*b* without interference from the wire engaging members 52 since the wire engaging member is located radially away from the coil 51*b*.

Figure 9:
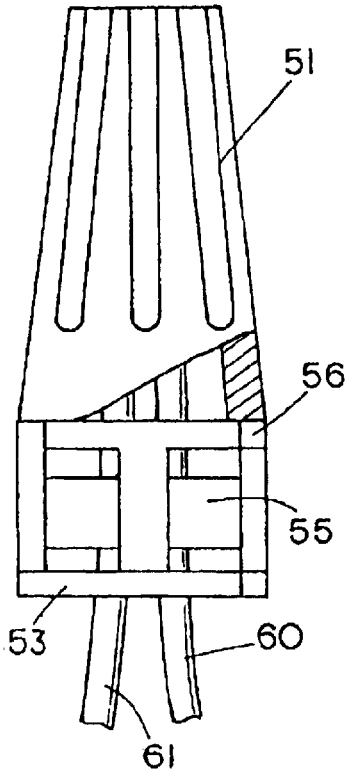
FIG. 9 is a side view of the embodiment of FIG. 7 in the closed strain relieving condition.

FIG. 9 is a side view of the embodiment of the strain inhibiting twist-on wire connector 50 in a closed condition about wires 60 and 61. In this condition clamp member 53 brings pad 55 proximate one side of wires 60 and 61 while the member 57 with the cross member are located on the opposite side of the wires thereby clamping the wires 60 and 61 therebetween so that any strain on the wires 60 and 61 is resisted by the clamping action of the wire engaging member 52 rather than by the electrical connection in the coil 51*b* of a twist on wire connector.

Although a viscous sealant is described herein other sealants including epoxy sealants and other types of sealants such as fire retarding sealants can be used herein.

We claim:

1. A twist-on wire connector comprising:

a housing, said housing carrying a spiral thread thereon for frictionally engaging a wire therein, said housing having an interior chamber;

a deformable member located in the interior chamber of said housing, said deformable member having a tapered exterior surface mating with the interior tapered surface of said housing so that axial displacement of the deformable member into the twist-on wire connector causes the deformable member to compress radially inward, said deformable member having a wire passageway therein to permit a wire access to the spiral thread in the housing; and a cap, said cap engageable with said housing to compress said deformable member to conform the wire passageway to bring the deformable member into an extended wire supporting condition.

2. The twist-on wire connector of claim 1 wherein the housing has an interior tapered surface for engaging the deformable member.

3. The twist-on wire connector of claim 1 wherein the housing includes an external thread for rotating engagement with said cap to bring said deformable member into a wire supporting condition.

4. The twist-on wire connector of claim 3 wherein the deformable member comprises a truncated cone with a central passageway therein.

5. The twist-on wire connector of claim 4 wherein the spiral thread in the housing comprises a wire coil.

6. The twist-on wire connector of claim 5 including a sealant located in a chamber of the twist-on wire connector.

7. The twist-on wire connector of claim 1 wherein the relationship of the size of the wire passageway therein to the external dimensions of a wire extended therethrough is such that when the cap is axially displaced toward the deformable member, the deformable member deforms about an exterior surface of the wire therein to prevent moisture from entering therepast.

8. The twist-on wire connector of claim 1 wherein the deformable member comprises an elastomer.

9. A method of inhibiting strain in a set of wires joined in a twist-on wire connector comprising the steps of:

inserting a plurality of wires into a wire passageway in a deformable member;

inserting the plurality of wires into a twist-on wire connector;

rotating the plurality of wires to bring the electrical wires into electrical connection with each other; and placing threads on an exterior of a housing of the twist-on wire connector and on an interior of an end cap and then rotating the cap to squeeze the deformable member into the housing and about the plurality of wires to bring the deformable member into pressure contact with the plurality of wires and the twist-on wire connector to thereby inhibit strain on the plurality of wires held in the electrical connection.

10. The method of claim 9 including the step of forming a converging surface on the interior of the housing so that when the deformable member is squeezed therein it collapses about the plurality of wires extending therethrough.

11. A twist-on wire connector;

a housing, said housing having an open end and a closed end, said housing having a chamber therein;

a deformable collar, said deformable collar having a wire passageway; and a collar-squeezing member, said collar-squeezing member having an interior thread rotatably mateable with an exterior thread of said housing, said collar-squeezing member rotatable into a compressed condition wherein the deformable collar is in frictional engagement over an extended length of a wire therein to provide a strain relieved connection therein.

12. The twist-on wire connector of claim 11 wherein the deformable collar comprises an elastomer.

13. The twist-on wire connector of claim 11 wherein the collar-squeezing member comprises a rotatable cap.

14. The twist-on wire connector of claim 11 wherein the deformable collar comprises a deformable material sufficiently compressible to yield as an external force is placed on the wire.

15. An electrical wire connector for inhibiting the strain on wires held in electrical connection by the frictional engagement of exposed ends of the wires in the wire connector with the wire connector including a member located entirely within an interior chamber of the wire connector for compressingly engaging at least a portion of a covering of at least one of the wires to yieldable restrain the wire from movement and thereby reduce or inhibit the strain on the wires connected by frictional engagement with each other.

16. The electrical wire connector of claim 15 including a wire coil in the connector for forming frictional engagement with the exposed ends of the wires.

17. The electrical connector of claim 15 wherein the connector includes an open end an closed end with the member comprising a wad of yield able material located proximate the open end of the connector.

18. A twist-on wire connector;

a housing, said housing having an open end and a closed end, said housing having a chamber therein;

a wire engaging member, said wire-engaging member adhesively secured with an end face of said housing and engaging a plurality of wires over an extended length of the plurality of wires therein to maintain the plurality of wires in a strain reduced condition.

19. The twist-on wire connector of claim 18 wherein the wire engaging member comprises a deformable member located at least partially in the chamber in the twist-on wire connector.

20. The twist-on wire connector of claim 19 wherein the deformable member is in radial compression engagement with the plurality of wires therein.

21. The twist-on wire connector of claim 20 wherein the deformable member is entirely held in the chamber of the housing by an end cap.

22. The twist-on wire connector of claim 21 wherein the deformable member comprises an electrical insulating material.

23. The twist-on wire connector of claim 22 wherein the twist-on wire connector includes a sealant therein.

24. The twist-on wire connector of claim 17 wherein the wire-engaging member comprises a first member and a second member secured to each other by a living hinge.

25. The twist-on wire connector of claim 17 wherein the wire-engaging member includes a pad for engaging a covering of a wire joined in an electrical connection in the twist-on wire connector.

26. The twist-on wire connector of claim 17 wherein the wire-engaging member includes a curved member to permit free access to a coil in the twist-on wire connector.

27. The twist-on wire connector of claim 17 including an epoxy sealant.

28. The twist-on wire connector of claim 17 including a fire retardant sealant.

* * * * *